United States Patent [19]

Lehfeldt et al.

[11] Patent Number: 4,754,567

[45] Date of Patent: Jul. 5, 1988

[54] DOUBLE SET TRIGGER MECHANISM

[76] Inventors: Carl R. Lehfeldt, 14287 Mulberry Dr., Los Gatos, Calif. 95030; Stuart V. Allen, 213 Idona Ave., Vellejo, Calif. 94591

[21] Appl. No.: 1,765

[22] Filed: Jan. 9, 1987

[51] Int. Cl.[4] ..... F41C 19/02

[52] U.S. Cl. ..... 42/69.02; 42/69.01

[58] Field of Search ..... 42/41, 69.01, 69.02, 42/69.03

[56] References Cited

U.S. PATENT DOCUMENTS

| | | | |
|---|---|---|---|
| 698,440 | 4/1902 | Brown | 42/69.01 |
| 4,005,540 | 2/1977 | Robinson | 421/69.02 X |
| 4,499,684 | 2/1985 | Repa | 42/69.01 |
| 4,625,444 | 12/1986 | Beretta | 42/69.02 |

*Primary Examiner*—Ted L. Parr

*Attorney, Agent, or Firm*—Rosenblum, Parish & Bacigalupi

[57] ABSTRACT

A double set trigger for a rifle is disclosed, consisting of a sear, a middle lever, a firing trigger, a set trigger, a catch for the set trigger, and a lever to sense the presence of the rifle bolt. The double set trigger has two springs, one for a light pull and one for a heavy pull. The force from the heavy pull spring is applied through the set trigger. The catch withholds the set trigger from the firing trigger for a light pull; the catch may be released by a second pull on the set trigger. The bolt sensing lever will release the set trigger if the bolt is withdrawn. A counterweight locates the center of gravity of the firing trigger concentric with the pivot point of the firing trigger.

12 Claims, 4 Drawing Sheets

DOUBLE SET TRIGGER MECHANISM

BACKGROUND OF THE INVENTION

1. Field of the Invention

This invention relates generally to rifle triggers, and specifically to double set triggers where the rear trigger serves to reduce the pull force on the forward firing trigger.

2. Description of the Prior Art

Sportsmen who engage in competitive bench rest shooting generally use special competition triggers to enhance accuracy. Important features of a competition trigger are light pull force, short lock time, and low vibration. Light pull force, usually approximately two ounces, decreases movement of the rifle in response to the pull of the trigger. Short lock time decreases movement of the rifle by decreasing the interval after the trigger is pulled and prior to ignition of the cartridge. Low vibration decreases movement of the rifle in response to the movement of the trigger mechanism.

The light pull force of a competition trigger is attained by a combination of low spring force on the trigger and reduction of friction on the trigger catch. In a standard trigger, the trigger catch restrains a sear which in turn restrains the firing pin. Competition triggers generally have a middle lever between the sear and the trigger that provides a mechanical advantage to reduce the force on the trigger catch.

Competition triggers are not generally used in hunting rifles because they are liable to accidental discharge. The light spring force that restrains the trigger in its cocked position is easily overcome by the impacts frequently encountered during hunting. Hunting rifles generally have a much higher pull force, usually approximately three pounds, to prevent accidental discharge resulting from impact.

The prior art of double set triggers, for example Repa, in U.S. Pat. No. 4,499,684, combines the safety of a standard hunting trigger with the accuracy of a competition trigger by adding a set trigger to the firing mechanism. The set trigger serves to reduce the pull force of the firing trigger. Double set triggers of the prior art use the set trigger to cock a hammer which may be released by a light pull on the firing trigger. The hammer strikes a catch to release the sear. Consequently, double set triggers of the prior art provide a light pull, but have a long lock time and high vibration.

Set triggers of the prior art are liable to accidental discharge if the bolt is withdrawn without firing the rifle. The bolt may then be closed with the firing mechanism set for the light pull, leaving the rifle susceptible to discharge resulting from impact.

SUMMARY OF THE PRESENT INVENTION

It is an object of the invention to provide a double set rifle trigger with light pull, short lock time, and low vibration comparable to the performance of a competition trigger.

Another object of the present invention is to provide a double set trigger that may be unset to the higher pull force by a second pull on the set trigger.

It is also an object of the instant invention to provide a double set trigger that will unset to the higher pull force if the bolt is withdrawn without firing the rifle.

It is a further object of the invention to provide a trigger that is more resistant to accidental discharge resulting from impact than are triggers of the prior art.

These and other objects are achieved according to the present invention, which consists of a double set trigger having a frame, a firing trigger mechanism, a trigger reset mechanism, and a set trigger mechanism.

The firing trigger mechanism includes a sear pivotally connected to the frame, a middle lever slidably and pivotally connected to the frame, a firing trigger pivotally connected to the frame, and a spring that presses on the firing trigger. The middle lever supports the sear in its cocked position, and is restrained by a catch means on the firing trigger. The spring serves to push the firing trigger toward its cocked position with a force equivalent to the light pull force.

The trigger reset mechanism consists of a spring means to return the sear and the middle lever to their cocked positions after the rifle has been fired and the bolt withdrawn.

The set trigger mechanism comprises a set trigger pivotally connected to the frame, a spring means that presses on the set trigger, a catch means pivotally connected to the frame, a spring means that presses on the catch means, a lever means pivotally connected to the sear, and a spring means that presses on the lever means. The set trigger is pressed against the firing trigger by its spring means with a force equivalent to the firing trigger heavy pull. The catch means withholds the set trigger from the firing trigger to provide the light pull. The catch spring means presses the catch toward its cocked position. The lever means is pressed by its spring means to release the set trigger from the catch means. The lever means is restrained by the rifle bolt pressing on the sear.

DESCRIPTION OF THE PREFERRED EMBODIMENT

Figure 1:
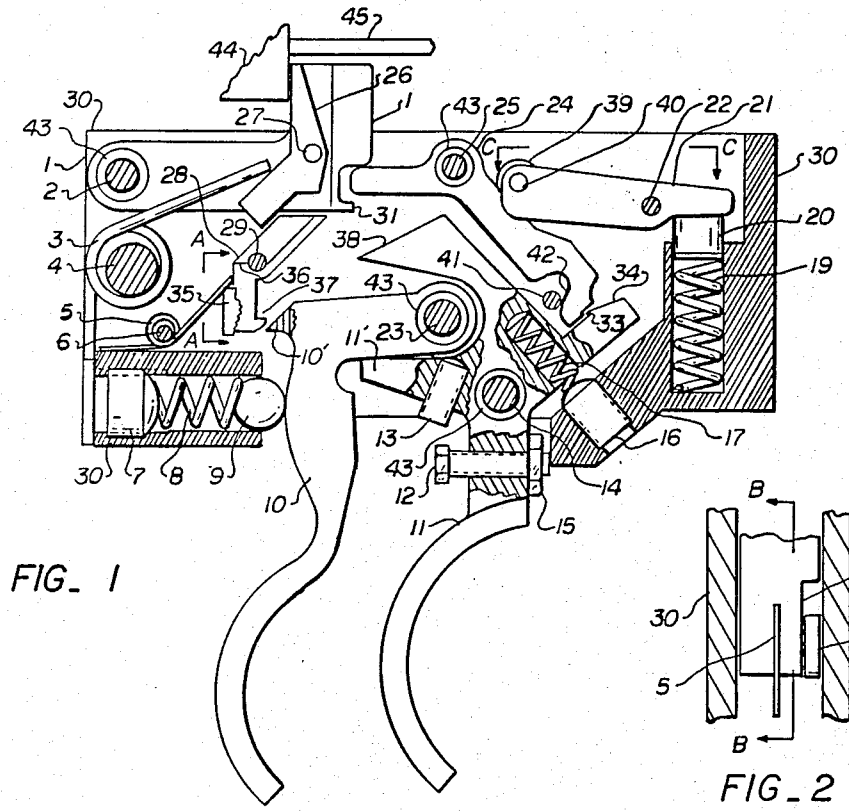
FIG. 1 is a side elevational view with one side of the frame removed to expose the parts of the double set trigger mechanism. All parts are shown in their initial, or cocked, positions.
Figure 7:
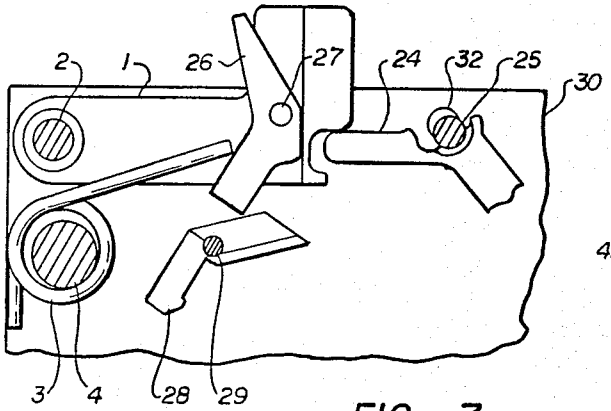
FIG. 7 is a partial side elevational view showing the sear, bolt sensing lever, bolt sensing lever spring, catch, and a portion of the middle lever with its slot in the frame. The bolt sensing lever and catch are shown in their positions when the bolt is withdrawn.

FIG. 1 shows a double set trigger mechanism. The mechanism comprises a frame 30, a sear 1, a middle lever 24, a firing trigger 11, a set trigger 10, a catch 28, and a striker sensing lever 26. In FIG. 1, the well-known relationship of a striker 44 and a firing pin 45 to sear 1 when the mechanism is in its initial (cocked) position is shown. The sear 1, firing trigger 11, set trigger 10, and catch 28 are pivotally connected to frame 30 by pins 2, 14, 23, and 29, respectively. Sear 1 is normally biased to rotate downwardly by a spring 3 acting through striker sensing lever 26. Striker sensing lever 26 is pivotally connected to sear 1 by a pin 27. FIG. 1 and FIG. 7 show middle lever 24 slidably and pivotally connected to frame 30 by a pin 25 in a slot 32. Sear 1, middle lever 24, firing trigger 11, and set trigger 10 have bosses 43 to reduce friction with the walls of frame 30. As is further explained below, a catch 28 is pivotally attached to frame 30 by a pin 29 and is biased into engagement with sear 1 by a catch spring 5. Note that as is further shown in FIG. 3, the rear side of trigger 10 includes a latch point 10' which is disposed beneath the lower extremity of catch 28. Consequently, in the initial position shown in FIG. 1 catch 28 is free to rotate against catch spring 5 and middle lever 24 retains sear 1 in its initial position. The positions for all parts of the trigger mechanism shown in FIG. 1 are hereafter referred to as the initial positions.

In the initial position, middle lever 24 supports sear 1 and is in turn restrained by a latch point 33 in firing trigger 11. A heavy pull spring 8 presses on set trigger 10 through a ball 9. The force applied to set trigger 10 by heavy pull spring 8 is adjusted by a first setscrew 7. Set trigger 10 in turn presses on firing trigger 11 to provide resistance equivalent to the heavy pull spring force. The travel of firing trigger 11 can be adjusted with an overtravel screw 13. Note that because set trigger 10 is circular at the point at which overtravel screw 13 contacts it, the travel of firing trigger 11 is the same regardless of the position of set trigger 10. The motion of firing trigger 11 in response to pressure from heavy pull spring 8 through set trigger 10 is limited by the impact on frame 30 of a screw 12 mounted through firing trigger 11 and held in place by a nut 15.

A rifle having the double set trigger mechanism may be discharged by application of a "heavy pull" force (approximately three pounds) finger pressure to firing trigger 11 causing it to rotate clockwise until latch point 33 is clear of middle lever 24. Set trigger 10 is engaged by trigger extremity 11' and also rotates clockwise about its pivot at pin 23, depressing heavy pull spring 8. Middle lever 24 is then free to rotate counterclockwise under the influence of spring 3 acting through striker 44 sensing lever 26 and sear 1 as sear 1 drops clear of the striker 44, allowing the rifle to fire.

Firing trigger 11 includes a counterweight 38 that shifts the center of gravity for firing trigger 11 to be concentric with the firing trigger pivot at pin 14. The moment on firing trigger 11 during acceleration due to impact is therefore reduced to nearly zero. In addition, because the center of gravity is concentric with firing trigger 11, firing trigger 11 is less likely to be moved by an impact to release middle lever 24, since the torque of such an impact on firing trigger 11 will be small.

Figure 4:
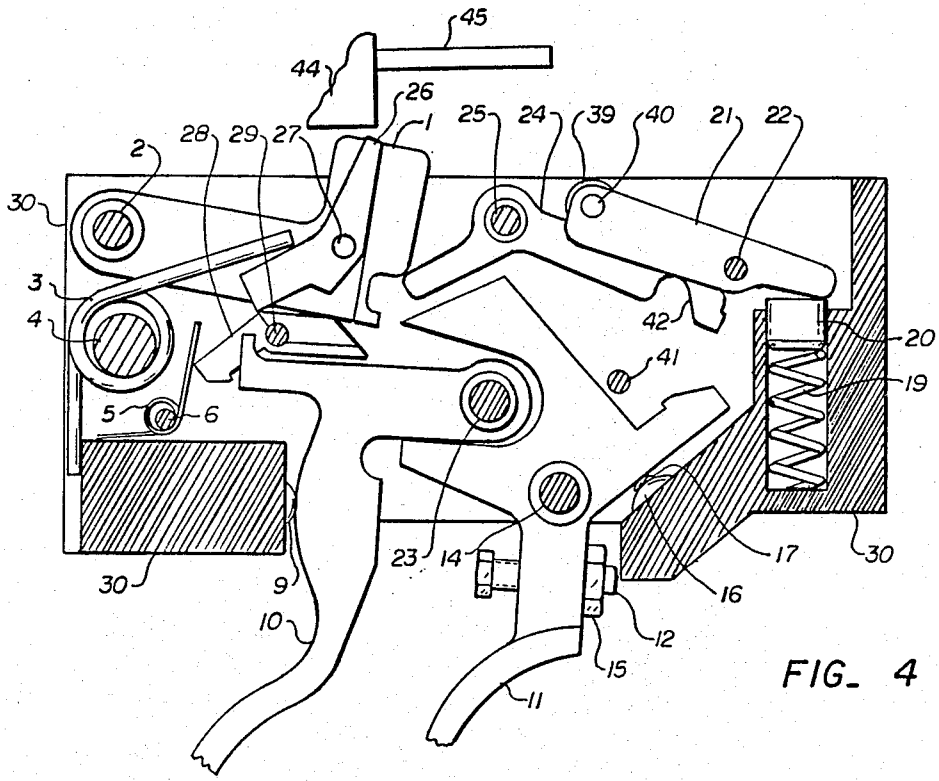
FIG. 4 is a side elevational view similar to FIG. 1, showing the positions of the parts after the mechanism has been fired.
Figure 8:
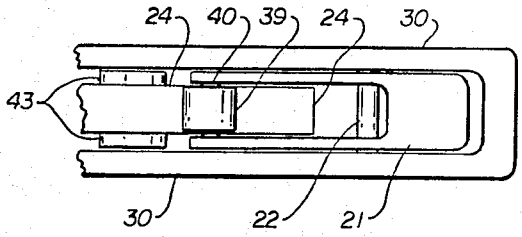
FIG. 8 is a plan view taken on line C—C of FIG. 1.

FIG. 4 shows the positions of the parts after the trigger mechanism has been fired. The rifle striker 44 holds sear 1 and middle lever 24 while firing trigger 11 and set trigger 10 return to their initial positions in response to pressure from heavy pull spring 8. When the rifle striker 44 is withdrawn, middle lever 24 and sear 1 are pressed back to their initial positions by a reset spring 19 acting through a piston 20, a reset lever 21, and a roller 39 that is pivotally attached to reset lever 21 by a pin 40. Hook 31 of sear 1 prevents sear 1 from moving upward beyond middle lever 24. FIG. 8 is a top view which shows the relationship between middle lever 24 and reset lever 21. As shown in FIG. 4, reset lever 21 is pivotally connected to frame 30 by a pin 22. Middle lever 24 is forced upward in slot 32 (FIG. 7) by a first ramp 34 on firing trigger 11 as it returns to its initial position behind latch point 33. After middle lever 24 clears latch point 33 in firing trigger 11, it is pressed down in slot 32 by spring 3 acting through striker 44 sensing lever 26 and sear 1, and by a pin 41 that presses on a second ramp 42 in middle lever 24. Spring 3 is held in position by a pin 4.

Figure 2:
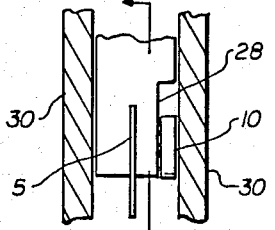
FIG. 2 is a cross-sectional view taken on line A—A of FIG. 1.
Figure 3:
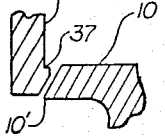
FIG. 3 is a side elevational view taken on line B—B of FIG. 2.
Figure 5:
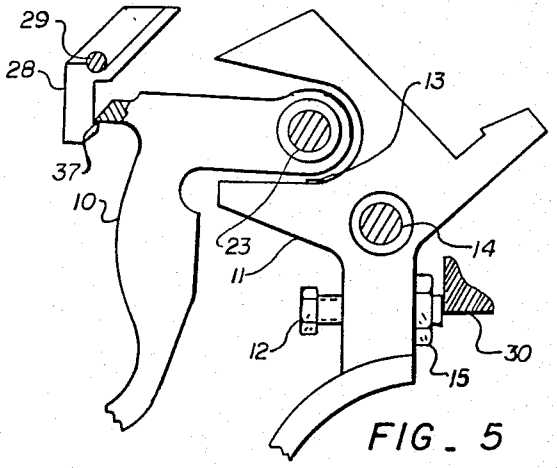
FIG. 5 is a partial side elevational view showing the firing trigger, set trigger, and catch. A partial cutaway shows the set trigger restrained by the catch, leaving only the light pull spring acting on the firing trigger.

FIG. 1 and FIG. 5 show how the trigger mechanism can be discharged with a "light pull" (approximately two ounces). Finger pressure is first applied to set trigger 10 causing it to rotate clockwise away from contact with firing trigger 11 until the latch point 10' of set trigger 10 lodges in a notch 37 in catch 28 (FIG. 5). Catch 28 is biased into latching engagement with latch point 10' by a catch spring 5 held in position by a pin 6. FIG. 2 shows a cross-section including frame 30, set trigger 10, and catch 28. FIG. 3 shows notch 37 of catch 28 and the latch point 10' of set trigger 10 in detail. As shown in FIG. 1 and the partial cutaway side view of set trigger 10 in FIG. 5, when latch point 10' lodges in notch 37, set trigger 10 is held in position out of engagement with trigger 11, thereby removing the biasing force of spring 8 on firing trigger 11 which is then restrained only by a light pull spring 17. Force in light pull spring 17 is adjusted using a second setscrew 16. The rifle is fired by finger pressure rotating firing trigger 11 to free middle lever 24 from latch point 33. The action of sear 1 and middle lever 24 during firing and trigger mechanism reset are as described above for the heavy pull. As shown in FIG. 4, in light pull firing, falling sear 1 strikes catch 28 and releases set trigger 10. All parts then return to their initial positions as described for heavy pull firing, above.

Figure 6:
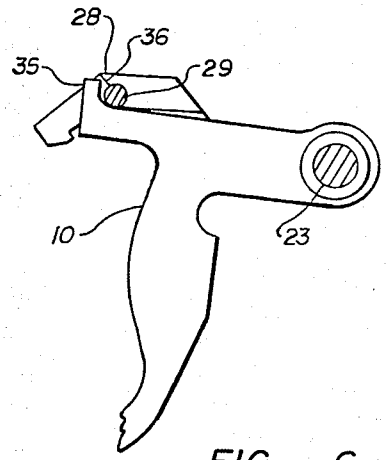
FIG. 6 is a partial side elevational view showing the set trigger and the catch. The set trigger has been pulled completely back, causing the catch to rotate and release the set trigger when the set trigger is released.

With reference to FIG. 5 and FIG. 6, if the rifle is not fired, set trigger 10 may be released from catch 28 by pulling set trigger 10 until a set trigger lifter 35 presses on a catch striker 36 and rotates catch 28 approximately 45 degrees. When set trigger 10 is released, it will fall past notch 37 in catch 28 before catch 28 returns to its initial position. Set trigger 10 will then return to its initial position resting on firing trigger 11.

With reference to FIG. 7, set trigger 10 (not shown) will also be released from catch 28 if the rifle bolt including striker 44 is withdrawn. Bolt sensing lever 26 will be pressed against catch 28 by striker 44 sensing spring 3. Catch 28 will rotate clockwise and release set trigger 10.

Whereas the preferred embodiment of the present invention has been described above, it is contemplated that other alternatives and modifications may become apparent to those skilled in the art after having read the above disclosure. It is therefore intended that the appended claims be interpreted as covering all such alterations and modifications as fall within the true spirit and scope of the invention.

What is claimed is:

1. A double set trigger mechanism for use in a firearm of the type having a sear-released striker and firing pin, comprising:

a frame;

a sear pivotally connected to said frame and rotatable between a cocked position and an uncocked position;

lever means rotatable between a sear releasing position and a sear supporting position for engaging said sear in its cocked position;

firing trigger means for releasably latching said lever means in its sear supporting position;

first spring means for providing a first rotational biasing force on said firing trigger means;

second spring means for providing a second rotational biasing force on said firing trigger means; and means for selectively removing said second biasing force from said firing trigger means, whereby if the second biasing force is not removed a relatively large pull force on said firing trigger means is required to unlatch said lever means from its sear supporting position and permit said lever means to release said sear from its cocked position to its uncocked position, and whereby if the second biasing force is removed from said firing trigger means only a relatively small pull force on said firing trigger means is required to unlatch said lever means from its sear supporting position and permit said lever means to release said sear from its cocked position to its uncocked position.

2. A double set trigger mechanism for use in a firearm of the type having a sear-released striker and firing pin, comprising:

a frame;

a set trigger pivotally connected to said frame, said set trigger having a set trigger lifter;

a heavy pull spring mounted in said frame, said heavy pull spring exerting a first resilient pivoting force on said set trigger toward an initial position, said first pivoting force being adjustable with a first setscrew;

a catch pivotally connected to said frame, said catch having a notch, said notch engaging said set trigger when said set trigger is urged with a heavy first pull force overcoming said heavy pull spring, said set trigger being held in a second position when engaged;

a firing trigger pivotally connected to said frame, said heavy pull spring exerting a second resilient pivoting force on said firing trigger toward a cocked position through said set trigger when said set trigger is not engaged by said notch, said firing trigger having a counterweight, a first ramp, and a latch point, said counterweight locating the center of gravity of said firing trigger concentric with the pivot point of said firing trigger;

a light pull spring mounted in said frame, said light pull spring exerting a third resilient pivoting force on said firing trigger toward its initial position, said third resilient pivoting force being adjustable with a second setscrew;

a sear pivotally connected to said frame, said sear restraining said firing pin when said sear is in a cocked position and releasing said firing pin when said sear pivots to an uncocked position;

a middle lever for supporting said sear in its cocked position, said middle lever pivotally and slidably connected to said frame and disposed between said sear and said firing trigger, said middle lever having a second ramp, said heavy pull spring and said light pull spring urging said latch point of said firing trigger to restrain said middle lever, said middle lever being released by said latch point when a second pull force exceeding the sum of said second and third pivoting forces is applied to said firing trigger if said set trigger is in its initial position and when a light third pull force less than said second pull force is applied to said firing trigger if said set trigger is in its second position, said middle lever pivoting to a second position when released by said latch point, permitting said sear to pivot to its uncocked position and releasing said striker and firing pin;

a catch striker mounted in said frame, said set trigger lifter being capable of pressing on said catch striker when a fourth pull force in excess of said heavy first pull force is exerted on said set trigger, said catch striker under such fourth pull force releasing said set trigger from said notch of said catch and permitting said set trigger to return to its initial position;

a striker sensing lever pivotally connected to said sear;

a striker sensing spring mounted in said frame, said striker sensing spring exerting a fourth resilient pivoting force on said striker sensing lever, urging said striker sensing lever against said catch, thereby releasing said catch when said striker is withdrawn and permitting said set trigger to return to its initial position;

a reset spring mounted in said frame; and a reset lever pivotally connected to said frame, said reset spring exerting a fifth resilient pivoting force on said middle lever and said sear through said reset lever, said first ramp of said firing trigger and said second ramp of said middle lever guiding said middle lever into said notch in said firing trigger as the sear is reset to its cocked position.

3. A double set trigger mechanism for use in a firearm of the type having a sear-released striker and firing pin, comprising:

a frame;

a set trigger pivotally connected to said frame;

first means for resiliently exerting a first pivoting force on said set trigger tending to rotate it toward an initial position;

second means for engaging and holding said set trigger in a second position when a first pull force of a first magnitude exceeding said first pivoting force is applied to said set trigger;

a firing trigger pivotally connected on a pivot point to said frame and rotatable between a cocked position and a firing position, said first means resiliently exerting a second pivoting force through said set trigger onto said firing trigger tending to rotate said firing trigger towards said cocked position when said set trigger is not engaged by said second means;

third means for resiliently exerting a third pivoting force on said firing trigger tending to rotate it toward its cocked position;

a sear pivotally connected to said frame and rotatable between a cocked position restraining said striker and firing pin and an uncocked position releasing said striker and firing pin; and fourth means disposed between said sear and said firing trigger and operative to hold said sear in said cocked position when said firing trigger is in its cocked position and operative to release said sear and alloy it to rotate into its uncocked position when said firing trigger is rotated into its firing position, whereby said firing trigger may be rotated into said firing position by a second pull force, of a second magnitude exceeding the sum of said second and third pivoting forces, applied to said firing trigger when said set trigger is in its initial position, or by a third pull force, of a third magnitude less than said second magnitude, applied to said firing trigger when said set trigger is its second position.

4. The double set trigger mechanism of claim 3, further comprising a fifth means for resetting said mechanism after said sear has been released to its uncocked position, by acting through said fourth means to reposition said firing trigger and said sear to their cocked positions.

5. The double set trigger mechanism of claim 4, wherein said firing trigger includes an integral counterweight to locate the center of gravity of said firing trigger concentric with the pivot point of said firing trigger.

6. The double set trigger mechanism of claim 3, wherein said firing trigger includes an integral counterweight to locate the center of gravity of said firing trigger concentric with the pivot point of said firing trigger.

7. The double set trigger mechanism of claim 3, further comprising a fifth means for releasing said set trigger from its second position to its initial position when a further pull force is applied to said set trigger.

8. The double set trigger mechanism of claim 3, further comprising a fifth means for sensing the presence of said striker and releasing said set trigger from its second position to its initial position when said striker is withdrawn.

9. The double set trigger mechanism of claim 8, further comprising a sixth means for releasing said set trigger from its second position to its initial position when a further force is applied to said set trigger.

10. The double set trigger mechanism of claim 9, further comprising a seventh means for resetting said mechanism after said sear has been released to its uncocked position, said seventh means acting through said fourth means to reposition said firing trigger and said sear to their cocked positions.

11. The double set trigger mechanism of claim 10, wherein said firing trigger includes an integral counterweight to locate the center of gravity of said firing trigger concentric with the pivot point of said firing trigger.

12. The double set trigger mechanism of claim 9, wherein said firing trigger includes an integral counterweight to locate the center of gravity of said firing trigger concentric with the pivot point of said firing trigger.

* * * * *